US007227966B2

(12) United States Patent
Kobayashi

(10) Patent No.: US 7,227,966 B2
(45) Date of Patent: Jun. 5, 2007

(54) PIEZO-ELECTRIC SPEAKER

(76) Inventor: Fujihiko Kobayashi, 19-12, Mitojimamotomachi, Fuji-shi, Shizuoka-ken (JP)

( * ) Notice: Subject to any disclaimer, the term of this patent is extended or adjusted under 35 U.S.C. 154(b) by 372 days.

(21) Appl. No.: 10/238,229

(22) Filed: Sep. 10, 2002

(65) Prior Publication Data

US 2003/0053645 A1 Mar. 20, 2003

(51) Int. Cl.
*H04R 25/00* (2006.01)

(52) U.S. Cl. ..... 381/190; 381/150; 381/191; 381/117; 381/111

(58) Field of Classification Search ..... 381/111, 381/150, 190, 191, 117
See application file for complete search history.

(56) References Cited

U.S. PATENT DOCUMENTS 5,852,337 A * 12/1998 Takeuchi et al. ..... 310/328
6,215,884 B1 * 4/2001 Parrella et al. ..... 381/190
6,453,050 B1 * 9/2002 Ogura et al. ..... 381/190
6,668,437 B1 * 12/2003 Maruyama et al. ..... 29/25.35

FOREIGN PATENT DOCUMENTS

| | | | |
|---|---|---|---|
| JP | 02-141098 | * | 5/1990 |
| JP | 06-022395 | | 1/1994 |
| JP | 09-163498 | | 6/1997 |
| JP | 11-113094 | | 4/1999 |

OTHER PUBLICATIONS

Co-pending U.S. Appl. No. 09/940,729, filed Aug. 28, 2001 entitled "Piezo-Electric Speaker".

* cited by examiner

*Primary Examiner*—Brian Tyrone Pendleton
*Assistant Examiner*—Con P. Tran
(74) *Attorney, Agent, or Firm*—Harness, Dickey & Pierce, P.L.C.

(57) ABSTRACT

A piezo-electric speaker ensures a uniform sound in a broad band and can easily reproduce a signal of large amplitude or sound. A piezo-electric speaker has a piezo-electric member to generate a vibration according to an electric signal applied thereto. A piezo-electric vibration plate converts the vibration to a sound. The piezo-electric vibration plate is positioned closely to the piezo-electric member. The piezo-electric vibration plate is divided into parts of any configuration and is connected to the piezo-electric member.

16 Claims, 9 Drawing Sheets

(a)

(b)

PIEZO-ELECTRIC SPEAKER

CROSS-REFERENCE TO RELATED APPLICATIONS

This application claims priority to Japanese Patent Application Nos. 2001-272907 filed Sep. 10, 2001 and 2002-215376 filed Jul. 24, 2002, which applications are herein expressly incorporated by reference.

FIELD OF THE INVENTION

The present invention relates to a piezo-electric speaker having a piezo-electric member.

BACKGROUND OF THE INVENTION

A piezo-electric speaker 40 of the prior art has, as shown in FIG. 10, has a completely round piezo-electric member 41 generating a vibration according to an electric signal applied thereto. A piezo-electric vibration plate 42 is adhered to the piezo-electric member 41 to convert the vibration to a sound. The piezo-electric member 41 and the piezo-electric vibration plate are adhered to each other with the centers of them being aligned.

However in the piezo-electric speaker 40 of the prior art, since the piezo-electric vibration plate 42 is made of a metallic plate-shaped member with less stretchability, no-vibrating portions are caused on the piezo-electric vibration plate 42 by a distortion such as creases generated during vibration. This makes it difficult to ensure a uniform sound in a broad band.

Since the diameter of the piezo-electric vibration plate 42 is limited, a large distortion of the piezo-electric vibration plate is caused when a signal of large sound is applied and therefore it is difficult to reproduce a clear sound. In addition, since the number of resonance point is limited, the sound pressure would be remarkably increased or reduced at particular frequencies corresponding to resonance points.

SUMMARY OF THE INVENTION

It is, therefore, an object of the present invention to provide a piezo-electric speaker which can ensure a uniform sound in a broad band and can easily reproduce a signal of large amplitude or sound.

According to one preferred embodiment of the present invention, a piezo-electric speaker comprises a piezo-electric member for generating a vibration according to an electric signal applied thereto. A piezo-electric vibration plate converts the vibration to a sound while being closely contacted to the piezo-electric member. The piezo-electric vibration plate is divided into parts of any configuration and is connected to the piezo-electric member.

According to this embodiment, since the piezo-electric vibration plate is divided into parts of any configuration, the distortion cannot be easily caused when the vibration plate vibrates and thus it is possible to ensure a uniform sound in a broad band and to easily reproducing a signal of large amplitude or sound.

According to another preferred embodiment of the present invention, a piezo-electric speaker comprises a piezo-electric member for generating a vibration according to an electric signal applied thereto. A piezo-electric vibration plate converts the vibration to a sound while being closely contacted to the piezo-electric member. The piezo-electric vibration plate is divided into several parts by dividing slits that extend from a position near the center of the piezo-electric vibration plate to the periphery.

According to this embodiment, since the piezo-electric vibration plate is divided by dividing slits, the distortion cannot be easily caused when the vibration plate vibrates. The vibration can be efficiently propagated from the center of the piezo-electric member to the periphery. Thus it is possible to ensure a uniform sound in a broad band and to easily reproducing a signal of large amplitude or sound.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Preferred embodiments of the present invention will be described with reference to the accompanied drawings in which;

FIGS. 1 (*c*)~(*f*) are front elevation views of other preferred embodiments of the piezo-electric speakers of the present invention;

DETAILED DESCRIPTION OF THE PREFERRED EMBODIMENTS

The following description of the preferred embodiment(s) is merely exemplary in nature and is in no way intended to limit the invention, its application, or uses.

Figure 1:
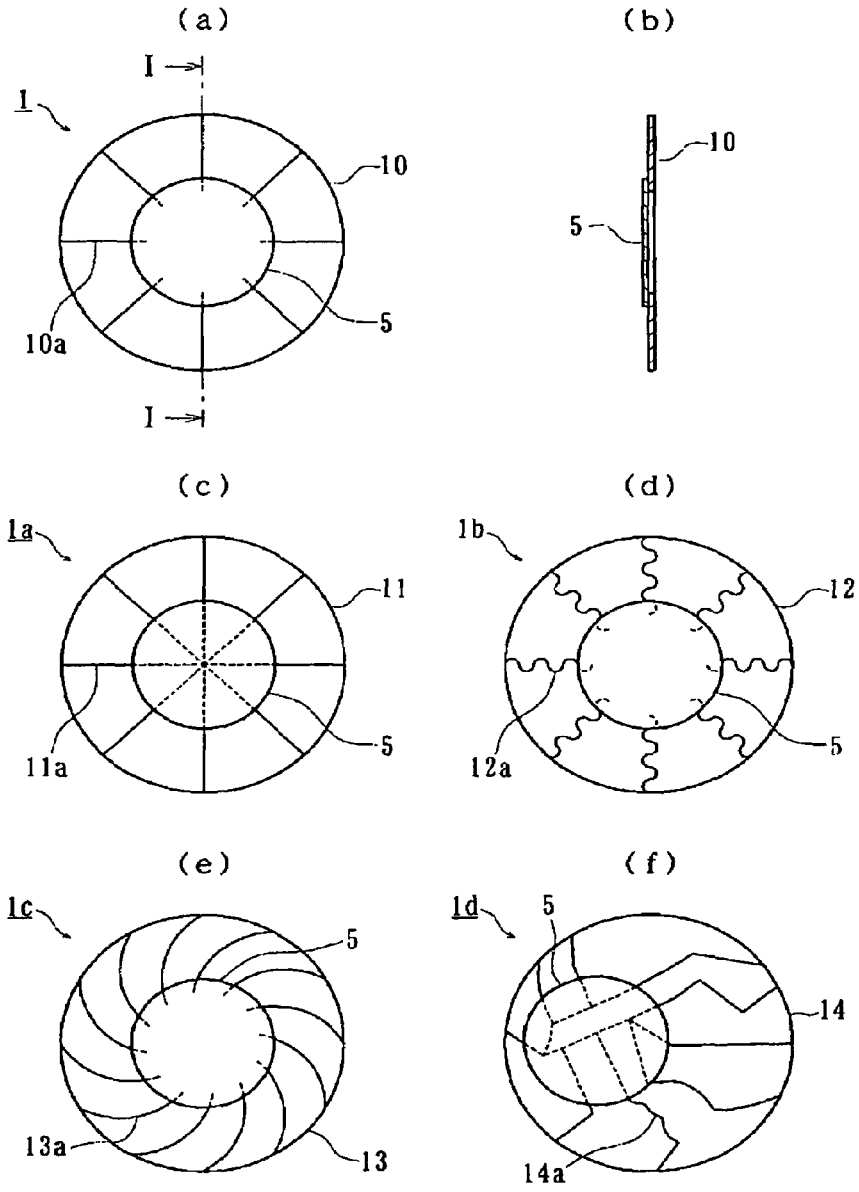
FIGS. 1(*a*) and (*b*) are, respectively, a front elevation view and a cross section view of one preferred embodiment of the piezo-electric speaker of the present invention.

A piezo-electric speaker 1 shown in FIGS. 1~8 is connected to audio instruments such as CD players or MD players generally used in homes for producing a sound. The piezo-electric speaker 1 comprises a piezo-electric member 5 and piezo-electric vibration plate 10 as shown in FIGS. 1(*a*) and (*b*). The piezo-electric member 5 is formed as a disc of piezo-electric ceramic generating the mechanical distortion based upon the application of electric signals. The piezo-electric vibration plate 10 is a metallic disc having a larger area than that that of the piezo-electric member 5. The piezo-electric vibration plate 10 is formed with dividing slits 10*a* radially extending from the periphery toward the center of the vibration plate 10. In the embodiments in which both the piezo-electric member 5 and the piezo-electric vibration plate 10 are formed as complete circles, the vibration centers of them are positioned at the center of the circular configuration.

The piezo-electric member 5 is adhered to the piezo-electric vibration plate 10 at the center. Thus, the piezo-electric vibration plate 10 can convert the mechanical distortion of the piezo-electric member 5 to the acoustic vibration. The materials of the piezo-electric vibration plate 10 include iron, copper, brass, stainless steel (SUS), titanium etc. as a metallic family, carbon graphite etc. as a carbon family, polyimide etc. as a resin family, or compound materials in which boron etc. are vapor deposited on the surfaces of said materials, and any other materials being able to propagate the acoustic vibration.

In the piezo-electric speaker 1 shown in FIG. 1(*a*), since the piezo-electric vibration plate 10 is divided by dividing slits 10*a* which extend from the center of vibration of the piezo-electric member 5 to the periphery of the vibration plate 10, the distortion cannot be easily generated because it is absorbed by the dividing slits 10*a* when the vibration plate 10 is vibrated. In addition, since the vibration is efficiently propagated from the center of the piezo-electric member 5 to the periphery of the vibration plate 10, it is possible to ensure a uniform sound pressure in a broad band.

The material of the piezo-electric member 5 is not limited to the piezo-electric ceramic and may be any material having a piezo-electric property such as a piezo-electric polymer membrane or piezo-electric composite material. The configuration of the piezo-electric member 5 and the piezo-electric vibration plate 10 is not limited to a circle and any other configuration may be adopted, which will be hereinafter described. The function and the material of the piezo-electric member and the piezo-electric vibration plate of embodiments hereinafter described are same as those of the piezo-electric member 5 and the piezo-electric vibration plate 10.

A piezo-electric vibration plate 11 shown in FIG. 1(*c*) is divided to eight parts equally separated along lines passing through its center and is adhered to the piezo-electric member 5 so that slits 11*a* are formed between two adjacent parts. In the piezo-electric speaker 1*a*, since the piezo-electric vibration plate 11 is radially divided to several parts by dividing slits 11*a*, which extend from the center of vibration toward the periphery of the vibration plate 11, the distortion cannot be easily generated in the vibration plate 11 when it vibrates. Thus, it is possible to ensure a uniform sound pressure in a broad frequency band and to easily reproduce a large acoustic signal.

A piezo-electric speaker 1*b* shown in FIG. 1(*d*) is substantially same as that of FIG. 1(*a*) except that the dividing slits are formed by curved lines not straight lines. A piezo-electric speaker 1*c* shown in FIG. 1(*e*) is substantially same as that of FIG. 1(*a*) except that the dividing slits are formed by radially extending parabolas not straight lines. The speakers 1*b* and 1*c* of FIG. 1(*d*) and (*e*) have functions and effects similar to those of the speaker 1 of FIG. 1(*a*).

In a piezo-electric speaker 1*d* shown in FIG. 1(*f*), a piezo-electric vibration plate 14 is divided into a plurality of parts each having any appropriate configuration which are adhered to the piezo-electric member 5 so that gaps 14*a* are formed therebetween. Since the vibration plate 14 is divided into parts, each having any appropriate configuration, the distortion cannot be easily generated in the vibration plate 14 when it vibrates. Thus, it is possible to ensure a uniform sound pressure in a broad frequency band and to easily reproduce a large acoustic signal.

Figure 2:
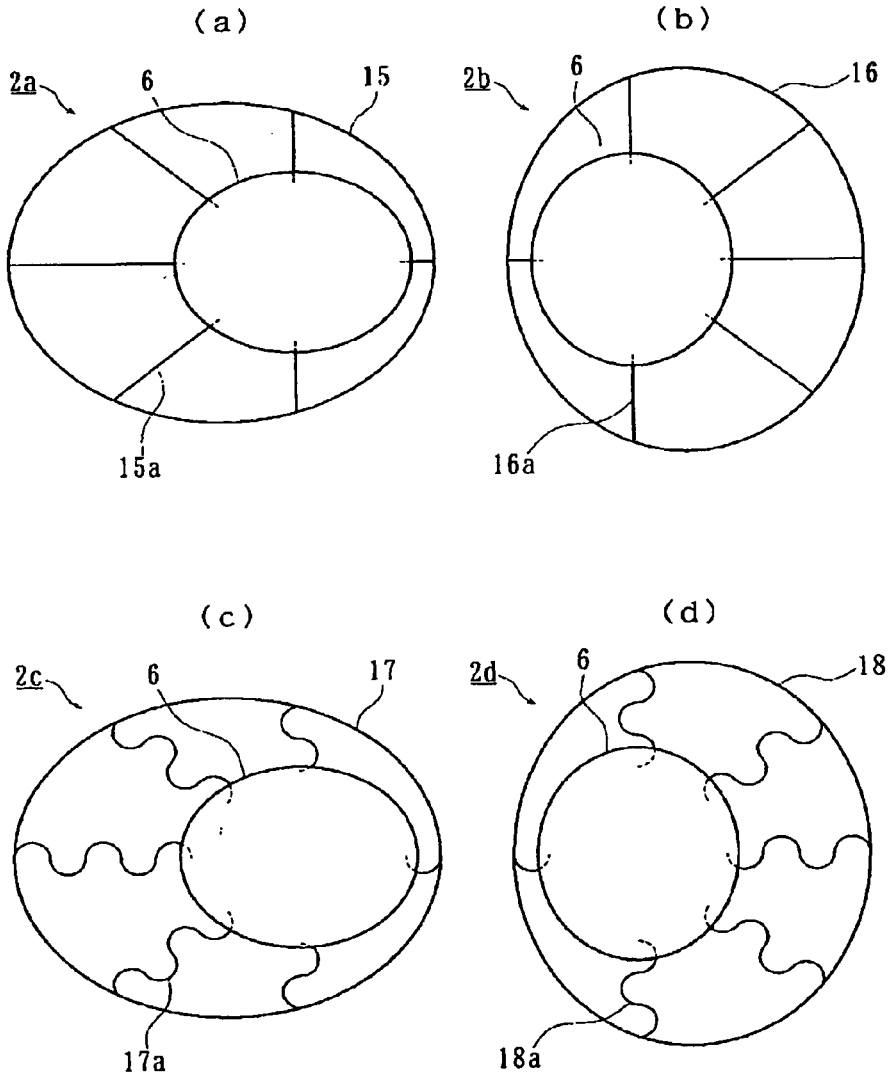
FIGS. 2(*a*)~(*d*) are front elevation views of preferred embodiments of oval piezo-electric speakers of the present invention.

In four piezo-electric speakers 2*a*~2*d* shown in FIG. 2, both a piezo electric member 6 and piezo-electric vibration plate 15~18 have an oval configuration. The piezo-electric member 6 of FIG. 2(*a*) is positioned at a position slightly shifted toward the right from the center of the oval vibration plate 15 on the major axis thereof and adhered thereto. The piezo-electric vibration plate 15 is formed with a plurality of dividing slits 15*a* that extend toward the center of the piezo-electric member 6 (i.e. the center of vibration) from near the periphery of the piezo-electric member 6 to the periphery of the piezo-electric vibration plate 15.

A piezo-electric speaker 2*b* shown in FIG. 2(*b*) is similar to that shown in FIG. 2(*a*). Accordingly, both a piezo electric member 6 and a piezo-electric vibration plate 16 have an oval configuration. However the piezo-electric member 6 of FIG. 2(*b*) is positioned at a position slightly shifted toward the left from the center of the oval vibration plate 16 on the major axis thereof and adhered thereto. The piezo-electric vibration plate 16 is also formed with a plurality of dividing slits 16*a* that extend toward the center of the piezo-electric member 6 (i.e. the center of vibration) from near the periphery of the piezo-electric member 6 to the periphery of the piezo-electric vibration plate 16.

A piezo-electric speaker 2*c* shown in FIG. 2(*c*) is similar to that shown in FIG. 2(*a*) except that dividing slits 17*a* are curved lines not straight lines. A piezo-electric speaker 2*d* shown in FIG. 2(*d*) is also similar to that shown in FIG. 2(*b*) except that dividing slits 18*a* are curved lines not straight lines. In the piezo-electric speakers 2*a*~2*d* shown in FIG. 2, the peripheries of the piezo-electric vibration plate 15~18 are eccentric relative to the center of vibration and thus the lengths of the vibration plates 15~18 from the center of vibration to the peripheries thereof are not constant. Accordingly, these speakers 2*a*~2*d* have many number of resonance points and thus it is possible to ensure a uniform sound pressure in a broad frequency band without causing remarkable increase or decrease of the sound pressure at particular frequencies.

Figure 3:
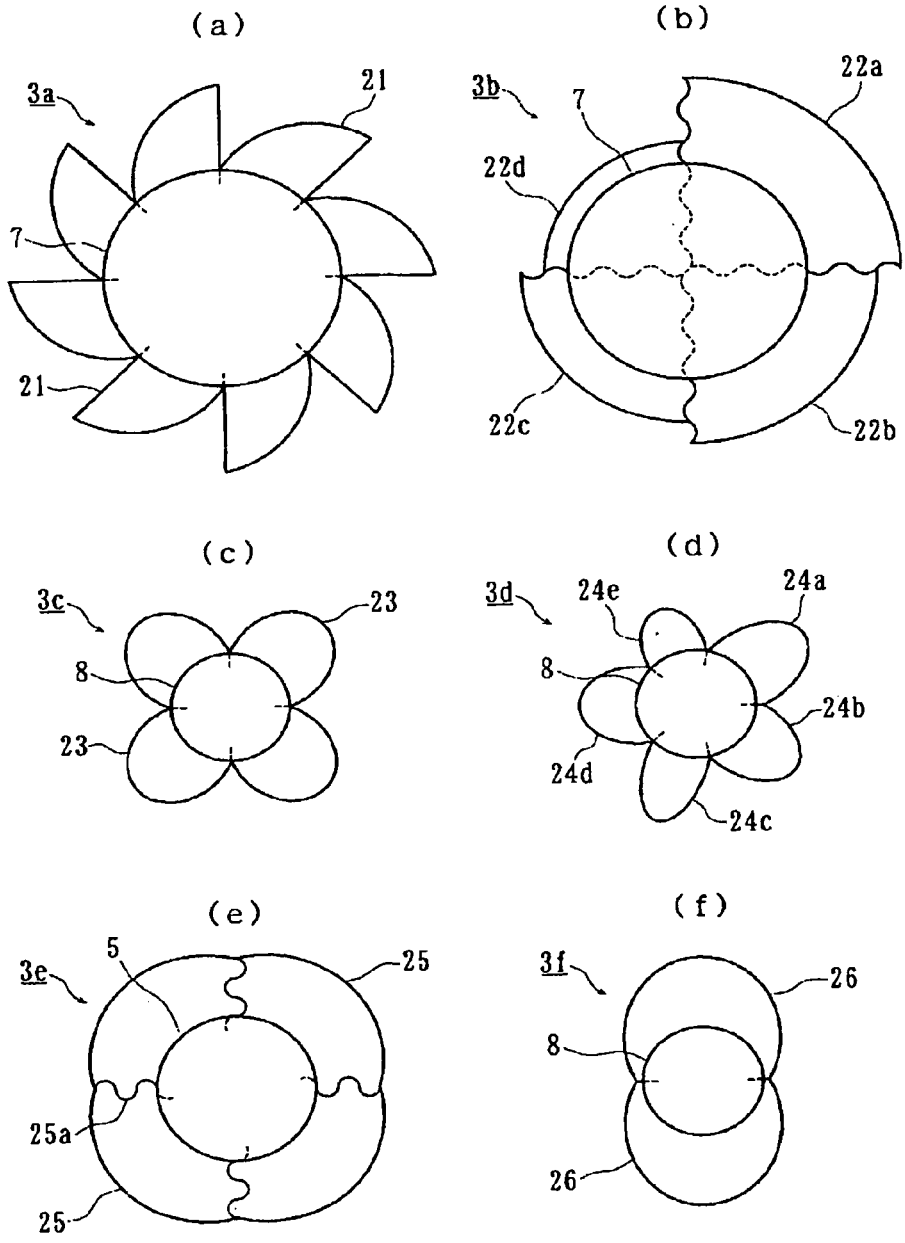
FIGS. 3(*a*)~(*f*) are front elevation views of preferred embodiments of the piezo-electric vibrating plates of the piezo-electric speakers of the present invention.

FIG. 3 shows examples of six speakers 3*a*~3*f* in which piezo-electric member 5, 7 and 8 have circular configurations and the peripheries of the piezo-electric vibration plate are curved. In a piezo-electric speaker 3*a* shown in FIG. 3(*a*), the periphery of a piezo-electric vibration plate 21 is formed by several circular arcs of complete round and straight lines like a wind wheel arranged so that the pointed portions of several semi-circular pieces are directed to the outside. In a speaker 3*b* shown in FIG. 3(*b*), the piezo-electric vibration plate is formed by four quadrants 22*a*~22*d* of different radii connected to each other via curved connections. In a speaker 3*c* shown in FIG. 3(*c*), the piezo-electric vibration plate 23 is formed by four oval pieces connected at their apexes to each other to form an "X" arrangement. In a speaker 3*d* shown in FIG. 3(*d*), piezo-electric vibration plate is formed by several (five in the illustrated example) different oval pieces 24*a*~24*e* arranged as a petal. In the examples of FIGS. 3(*c*) and (*d*), either one of oval pieces may be changed to circular pieces.

A piezo-electric vibration plate 25 of a piezo-electric speaker 3*e* shown in FIG. 3(*e*) is formed by four largest quadrants divided at a position shifted from the center of a circle. That is the periphery of the vibration plate 25 is formed by four circular arcs of complete round of the same radius. The four quadrants are connected to each other via dividing slits 25*a*. A piezo-electric vibration plate 26 of the piezo-electric speaker 3*f* shown in FIG. 3(*f*) is formed by two ovals connected to each other so that their major axes are aligned.

In any one of the piezo-electric speakers 3*a*~3*f*, since the distance from the center of vibration to the periphery of the vibration plate is not constant, they have a number of resonance points and thus it is possible to ensure a uniform sound pressure in a broad frequency band without causing remarkable increase or decrease of the sound pressure at particular frequencies, and also to ensure a uniform sound pressure in a broad frequency band.

Figure 4:
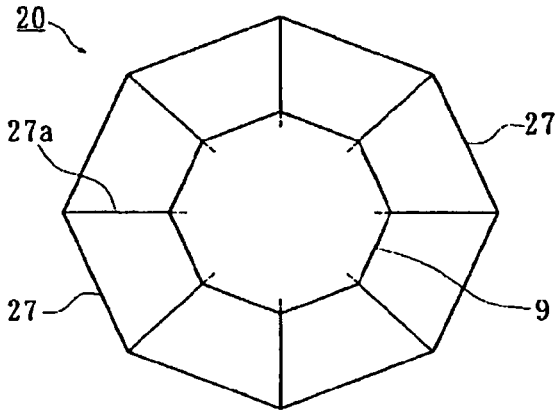
FIG. 4 is a front elevation view of a polygonal piezo-electric speaker of the present invention.

FIG. 4 shows a piezo-electric speaker 20 in which both a piezo-electric member 9 and a piezo-electric vibration plate 27 are formed by polygons. Although a regular octagon is shown in the illustrated example, any other polygon may be used and any combination of the polygon and the circular arc (circular arc of complete round or eccentric circular arc) may also be used. Also in this speaker 20, since the distance from the center of vibration to the periphery of the vibration plate is not constant, it has a number of resonance points and thus it is possible to ensure a uniform sound pressure in a broad frequency band without causing remarkable increase or decrease of the sound pressure at particular frequencies, and also to ensure a uniform sound pressure in a broad frequency band.

Figure 5:
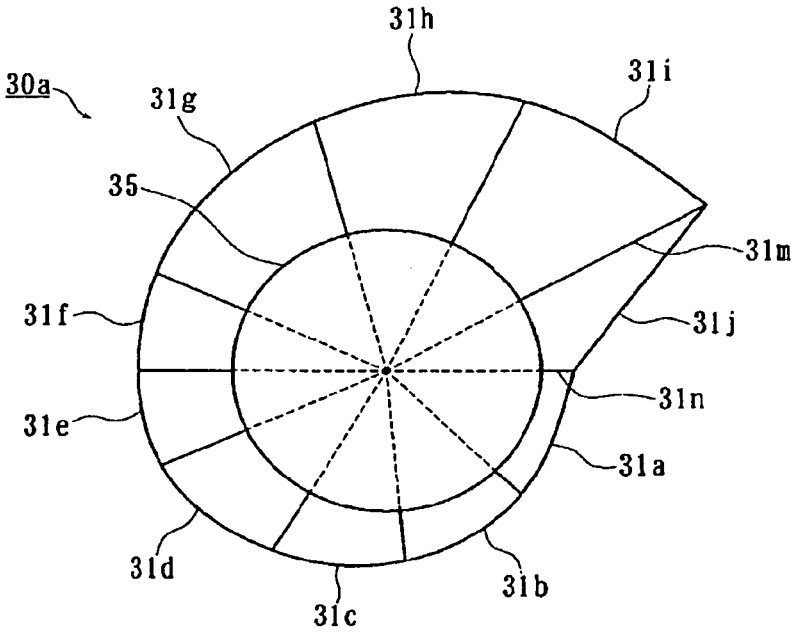
FIG. 5 is a front elevation view of a piezo-electric speaker having eccentric arcs of which radii gradually increasing of the present invention.

In the piezo-electric speaker 30*a* shown in FIG. 5, the periphery of the piezo-electric vibration plate is formed by radially dividing several parts 31*a*~31*i* and an auxiliary movable region 31*j*. The parts 31*a*~31*i* are adhered to a piezo-electric member 35 and the radii of these parts 31*a*~31*i* gradually increase from a shortest radius 31*n* to a longest radius 31*m*. A predetermined depression angle is formed by a line connecting the outer ends of the longest radius 31*m* and the shortest radius 31*n*. The auxiliary movable region 31*j* is defined by the longest radius 31*m*, the shortest radii 31*n* and the line connecting the outer ends of these radius 31*m* and 31*n*.

Since there is a large difference of radius between the parts 31*a* and 31*i* of the piezo-electric vibration plate, if no auxiliary movable region to smoothly connect the periphery is present between them, undesirable vibration or distortion would be generated during the vibration of the piezo-electric vibration plate. In the embodiment of the piezo-electric speaker 30*a* shown in FIG. 5, the periphery of the auxiliary movable region i.e. the part 31*j* is formed by a straight line and that of the speaker 30*b* shown in FIG. 6 is formed by a curved line.

In the piezo-electric speakers 30*a* and 30*b*, since the peripheries of the parts 31*a*~31*j* and 32*a*~32*j* gradually increase and the lines connecting, respectively, the outer ends of the longest radius 31*m* and 32*m* and the shortest radius 31*n* and 32*n* form the predetermined depression angle, it is possible to ensure a uniform sound pressure in a broad frequency band without causing remarkable increase or decrease of the sound pressure at particular frequencies, and also to ensure a uniform sound pressure in a broad frequency band.

Figure 6:
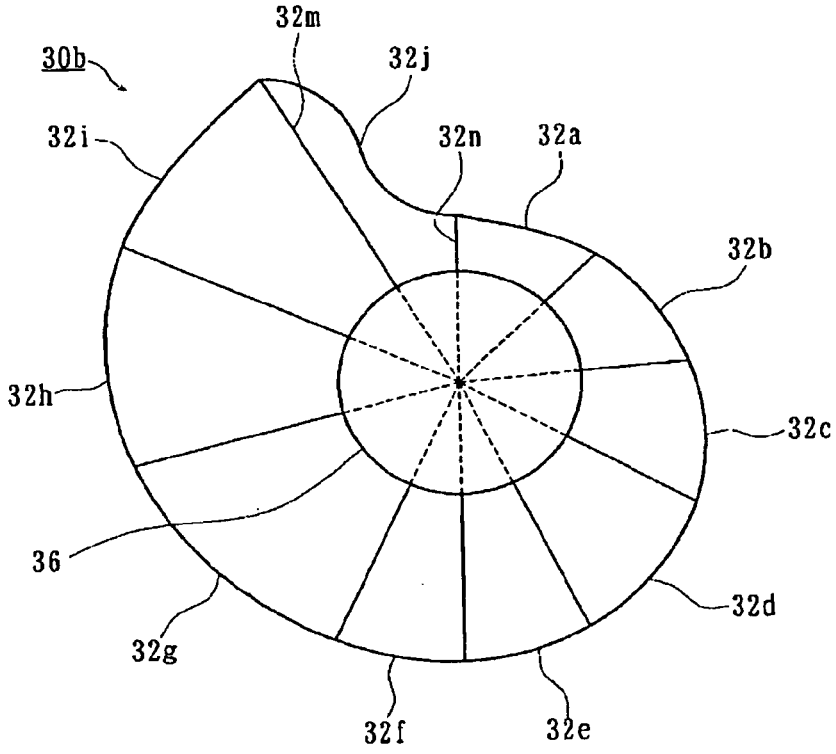
FIG. 6 is a front elevation view of another embodiment of the piezo-electric speaker having eccentric arcs of which radii gradually increasing of the present invention.
Figure 7:
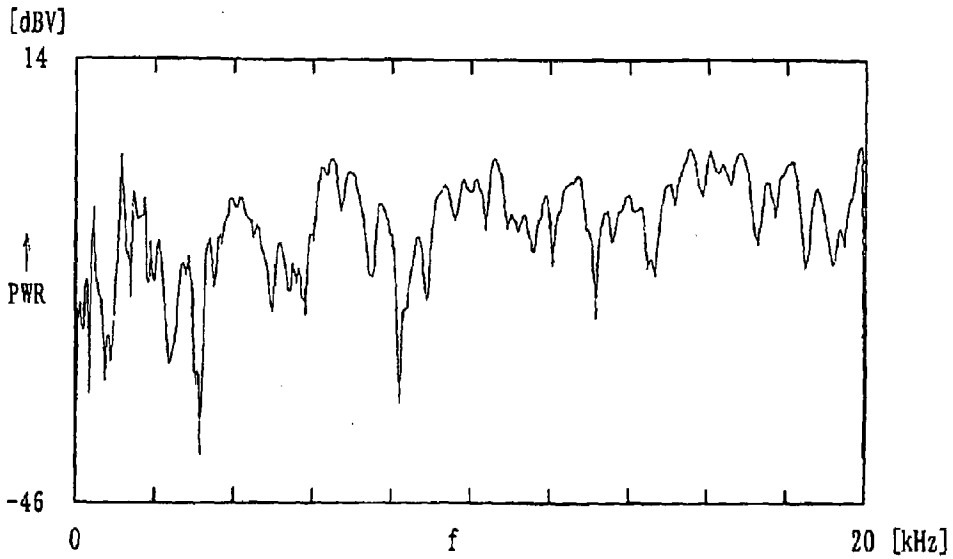
FIG. 7 is a graph showing the sound pressure characteristics.

FIG. 7 is a graph showing the sound pressure obtained by driving the piezo-electric speaker 30*b* shown in FIG. 6. The specifications of the speaker 30*b* are as follows. The piezo-electric member 36 is made of piezo-electric ceramics, the diameter is about 50 mm, and the thickness is about 0.18 mm. The piezo-electric vibration plates 32*a*~32*j* are made of SUS, the longest radius 32*m* is about 60 mm from the center of the piezo-electric member 36, and the shortest radius 32*n* is about 30 mm from the center of the piezo-electric member 36. Although the piezo-electric speaker 30*b* is very large as compared with that of the prior art, the periphery of the piezo-electric vibration plates 32*a*~32*i* are formed by the eccentric circular arcs in which the radii gradually increase and the line connecting the outer ends of the longest radius 31*m* and the shortest radius 31*n* forms the predetermined depression angle and the auxiliary movable region. Thus the distance from the center of vibration to the periphery of the vibration plate is not constant. Accordingly, the speaker has a number of resonance points and thus it is possible to ensure a uniform sound pressure in a broad frequency band without causing remarkable increase or decrease of the sound pressure at particular frequencies.

Figure 8:
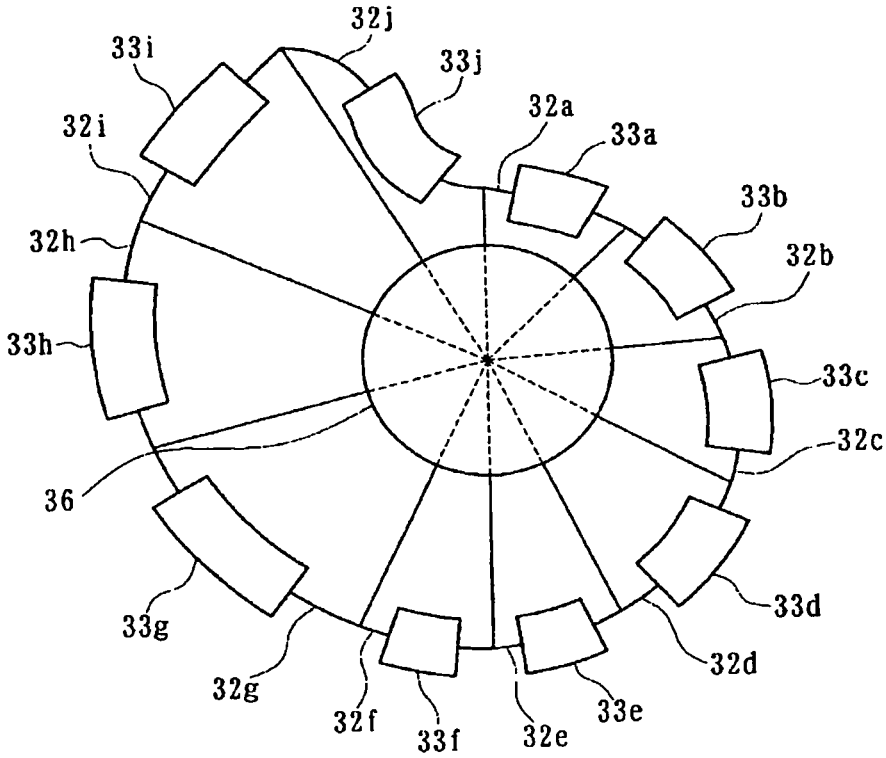
FIG. 8 is a front elevation view showing a method for mounting the piezo-electric speaker.

FIG. 8 shows a method for mounting the piezo-electric speaker 30*b* of FIG. 6 to a speaker box means. Supporting plates 33*a*~33*j* with vibration propagating ability, are respectively adhered to each of the divided piezo-electric vibration plates 32*a*~32*j*. These supporting plates 33*a*~33*j* connect the piezo-electric vibration plates 32*a*~32*j* to a suitable box means. The supporting plates 33*a*~33*j* may be made of materials with a high elasticity and a high sound propagating velocity such as titanium, carbon graphite, beryllium etc. When the piezo-electric vibration plates 32*a*~32*j* are supported on the box means, via the supporting plates 33*a*~33*j*, the vibrations of the piezo-electric vibration plates 32*a*~32*j* can be independently propagated to the box means and thus it is possible to ensure a uniform sound pressure in a broad frequency band.

In the piezo-electric vibrating plate formed by the divided parts as shown in FIGS. 1~8, for example, in the piezo-electric speaker 30*b* in FIG. 6, it is possible to use materials with a different modulus of elasticity in the respective piezo-electric vibration plates 32*a*~32*j*. In this specification, the modulus of elasticity means the modulus of longitudinal elasticity (Young's modulus). The higher the modulus of elasticity, the higher the propagatable frequency (resonance point). Of course, it is possible to ensure a uniform sound pressure in a broad frequency band by the piezo-electric speaker 30*b* using a material of same modulus of elasticity in the piezo-electric vibration plates 32*a*~32*j*. However it is possible to change the material of any part of the piezo-electric vibration plates having a radius influencing the reproducing of frequency to the other material having a different modulus of elasticity so as to adjust the part to obtain a further uniformed sound pressure. This makes it possible to further finely adjust the sound pressure due to the change of the resonance point of the piezo-electric vibration plates 32*a*~32*j*. In this case, the modulus of elasticity is appropriately selected in accordance with the change of the sound pressure. By forming the piezo-electric vibration plate with divided parts having different moduli of elasticity, it is possible to adjust the depression or projection of sound pressure at a particular frequency and thus to further easily ensure a uniform sound pressure in a broad frequency.

Since the piezo-electric member is very thin piezo-electric ceramics, cracks form in it due to the distortion of the piezo-electric vibration plate generated by application of a signal causing an enormous vibration. In such a case, it is possible to prevent the generation of cracks at the divided portions of the piezo-electric vibration plates by providing a reinforcing plate 39 as shown in FIG. 9.

Figure 9:
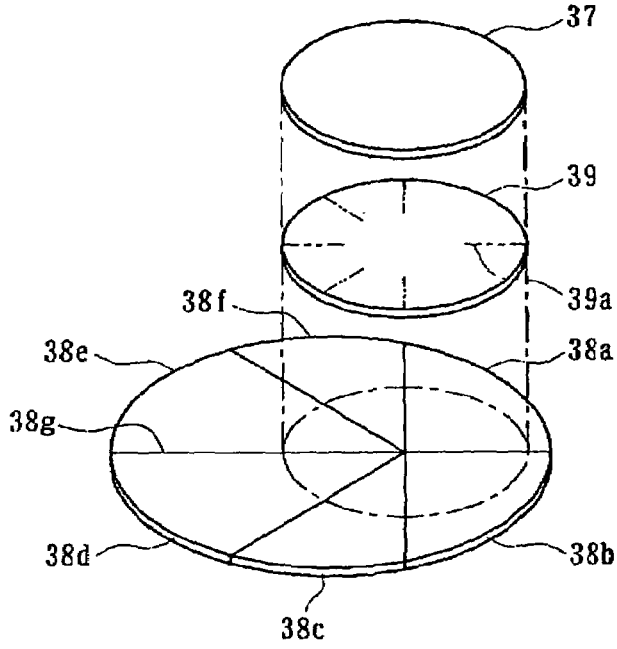
FIG. 9(*a*) is an exploded view of a speaker having a reinforcing plate, and FIG. 9(*b*) is a cross section view of the speaker of FIG. 9(*a*)
Figure 9:
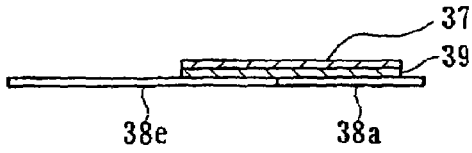
Figure 10:
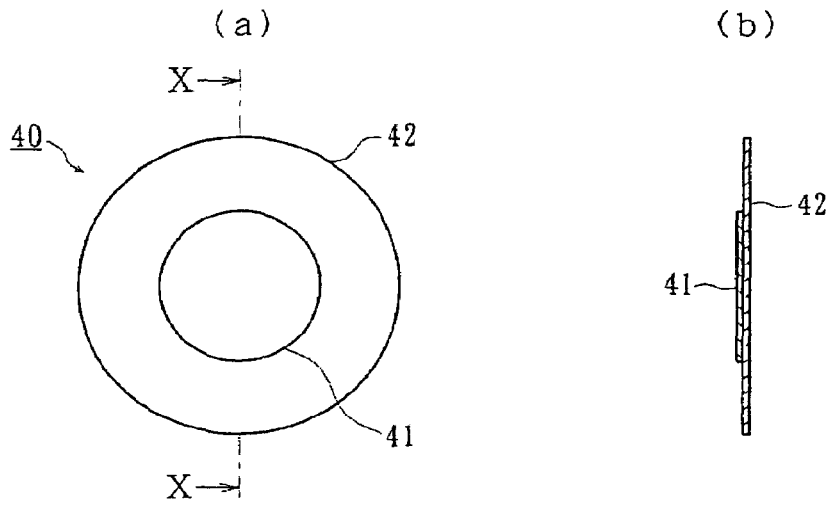
Fig. 10 Prior Art
FIG. 10(*a*) is a front elevation view of a piezo-electric speaker of the prior art, and FIG. 10(*b*) is a cross section view of the speaker of FIG. 10(*a*).

More particularly as shown in FIG. 9, the reinforcing plate 39 has substantially the same configuration as that of a piezo-electric member 37 and is arranged between the piezo-electric member 37 and piezo-electric vibration plates 38*a*~38*f* and adhered to them. The reinforcing plate 39 is formed of material with acoustic vibration propagating ability and rigidity sufficient to prevent the generation of cracks of the piezo-electric member 37 due to the vibration of the piezo-electric vibration plates. The reinforcing plate 39 may be formed of metal similar to the piezo-electric vibration plates 38*a*~38*f*, or formed of synthetic resin or carbon family material if they have necessary rigidity to prevent the generation of the cracks. The configuration of the reinforcing plate 39 is preferably the same as that of the piezo-electric member 37, however, it may be larger than that of the latter. The provision of dividing slits 39*a* in the reinforcing plate 39 that extend along the dividing slits 38*g* makes it possible to reduce loss of vibration propagation and to ensure a uniform sound pressure in a broad frequency.

The present invention has been described with reference to the preferred embodiment. Obviously, modifications and alternations will occur to those of ordinary skill in the art upon reading and understanding the preceding detailed description. It is intended that the present invention be construed as including all such alternations and modifications insofar as they come within the scope of the appended claims or the equivalents thereof.

What is claimed is:

1. A piezo-electric speaker comprising:

a piezo-electric member for generating a vibration according to an electric signal applied thereto; a piezo-electric vibration plate for converting the vibration to a sound, said piezo-electric vibration plate being closely positioned to the piezo-electric member; and said piezo-electric vibration plate divided into separate and distinct parts of any configuration and being connected to the piezo-electric member and an open slit between said separate parts for enabling the parts to vibrate independent of one another, said open slit extending from said piezo-electric member to a periphery of said piezo-electric vibration parts to separate the piezo-electric vibration parts from one another.

2. A piezo-electric speaker of claim 1 wherein the piezo-electric vibration plate is radially divided into several parts radially extending from a position near the center of the piezoelectric vibration plate to the periphery.

3. A piezo-electric speaker of claim 1 wherein the periphery of the piezo-electric vibration plate is eccentric from the center of vibration.

4. A piezo-electric speaker of claim 1 wherein the periphery of the piezo-electric vibration plate is formed by a plurality of circular arcs.

5. A piezo-electric speaker of claims 1 wherein the periphery of the piezo-electric vibration plate is formed by at least one eccentric circular arc.

6. A piezo-electric speaker of claim 1 wherein the periphery of the piezo-electric vibration plate is formed by at least one circular arc and at least one eccentric circular arc.

7. A piezo-electric speaker of claim 1 wherein the periphery of the piezo-electric vibration plate is formed by at least one polygon.

8. A piezo-electric speaker of claim 1 wherein the periphery of the piezo-electric vibration plate is formed by at least one circular arc and at least one polygon.

9. A piezo-electric speaker of claim 1 wherein the periphery of the piezo-electric vibration plate is formed by at least one eccentric circular arc and at least one polygon.

10. A piezo-electric speaker of claim 1 wherein the periphery of the piezo-electric vibration plate is formed by an eccentric circular arc in which its radius is gradually increased and a predetermined depression angle is formed by a line connecting the outer ends of the longest radius and the shortest radius, and formed by an auxiliary movable region defined by the longest and shortest radii.

11. A piezo-electric speaker of claims 1 wherein the center of vibration of the piezoelectric member and the center of the piezo-electric vibration plate are positioned apart from each other.

12. A piezo-electric speaker of claims 1 wherein each of the divided parts of the piezo-electric vibration plate has a supporting plate having vibration propagating ability, and the piezo-electric vibration plate is held on a box means via the supporting plates.

13. A piezo-electric speaker of claim 1 wherein each of the divided parts of the piezoelectric vibration plate has the modulus of elasticity different from one another.

14. A piezo-electric speaker of claim 1 wherein there is arranged between the piezoelectric member and the piezo-electric vibration plate a reinforcing plate having a substantially same configuration as the piezo-electric member, the vibration propagating ability, and a predetermined rigidity.

15. A piezo-electric speaker of claim 14 wherein the reinforcing plate is divided by dividing slits extending from a position near the center of the piezo-electric vibration plate to the periphery thereof.

16. A piezo-electric speaker comprising:

a piezo-electric member for generating a vibration according to an electric signal applied thereto;

a piezo-electric vibration plate for converting the vibration to a sound, said piezoelectric vibration plate being closely positioned to the piezo-electric member; and said piezo-electric vibration plate being divided into several separate and distinct parts by dividing open slits extending from a position near the center of the piezo-electric vibration plate to the periphery thereof for enabling the separate parts to vibrate independent of one another, said open slit extending from said piezo-electric member to a periphery of said piezo-electric vibration parts to separate the piezo-electric vibration parts from one another.

* * * * *

UNITED STATES PATENT AND TRADEMARK OFFICE

CERTIFICATE OF CORRECTION

PATENT NO. : 7,227,966 B2
APPLICATION NO. : 10/238229
DATED : June 5, 2007
INVENTOR(S) : Fujihiko Kobayashi It is certified that error appears in the above-identified patent and that said Letters Patent is hereby corrected as shown below:

Title Page,
Insert the following heading and information:
Item -- [30] Foreign Application Priority Data
Sep. 10, 2001 [JP] .....2001-272907
Jul. 24, 2002 [JP] .....2002-215376 --

Signed and Sealed this

Sixth Day of November, 2007

JON W. DUDAS
*Director of the United States Patent and Trademark Office*